US011752473B2

(12) United States Patent
Hirschberg

(10) Patent No.: US 11,752,473 B2
(45) Date of Patent: Sep. 12, 2023

(54) MIXER DUCT AND PROCESS OF OPERATION

(71) Applicant: Sulzer Management AG, Winterthur (CH)

(72) Inventor: Sebastian Hirschberg, Winterthur (CH)

(73) Assignee: SULZER MANAGEMENT AG, Winterthur (CH)

( * ) Notice: Subject to any disclaimer, the term of this patent is extended or adjusted under 35 U.S.C. 154(b) by 404 days.

(21) Appl. No.: 16/761,324

(22) PCT Filed: Nov. 6, 2018

(86) PCT No.: PCT/EP2018/080271
§ 371 (c)(1),
(2) Date: May 4, 2020

(87) PCT Pub. No.: WO2019/086693
PCT Pub. Date: May 9, 2019

(65) Prior Publication Data

US 2021/0187450 A1 Jun. 24, 2021

(30) Foreign Application Priority Data

Nov. 6, 2017 (EP) ..... 17200102

(51) Int. Cl.
*B01F 5/06* (2006.01)
*B01F 5/04* (2006.01)
(Continued)

(52) U.S. Cl.
CPC .... *B01F 25/43161* (2022.01); *B01F 25/3131* (2022.01); *B01F 25/3141* (2022.01);
(Continued)

(58) Field of Classification Search
CPC ..... B01F 25/3131; B01F 25/3141; B01F 25/4316; B01F 25/43161; B01F 25/43163; B01F 25/431971
See application file for complete search history.

(56) References Cited

U.S. PATENT DOCUMENTS 3,297,305 A * 1/1967 Walden ..... B01F 25/3131 48/189.4
4,167,987 A * 9/1979 Turner ..... F01N 1/083 181/255
(Continued)

FOREIGN PATENT DOCUMENTS

CN 1148518 A 4/1997
CN 1550256 A 12/2004
(Continued)

OTHER PUBLICATIONS

Chinese Office Action dated Nov. 24, 2021 in corresponding Chinese Application No. 201880085288.3.
(Continued)

*Primary Examiner* — Elizabeth Insler
(74) *Attorney, Agent, or Firm* — GLOBAL IP COUNSELORS, LLP

(57) ABSTRACT

A mixer duct for mixing of a turbulent flow includes an inlet, an outlet in fluid communication with the inlet, and at least one static mixer element located between the inlet and the outlet. The at least one static mixer element includes at least two at least substantially coplanar plate-like segments spaced apart by a substantially longitudinal gap. Each segment is attached to a duct wall and comprises at least two free edges, with one free edge being a leading edge and the other free edge adjacent to the longitudinal gap. The at least two segments are inclined relative to a duct axis so that their leading edge is oriented up-stream in the mixer duct and
(Continued)

substantially perpendicular to a direction of a main fluid flow.

16 Claims, 6 Drawing Sheets

(51) Int. Cl.

| | |
|---|---|
| ***B01F 25/431*** | (2022.01) |
| ***B01F 25/313*** | (2022.01) |
| ***B01F 25/314*** | (2022.01) |
| ***B01F 25/421*** | (2022.01) |
| *B01F 25/00* | (2022.01) |
| *B01F 101/00* | (2022.01) |

(52) U.S. Cl.
CPC .... *B01F 25/31331* (2022.01); *B01F 25/4231* (2022.01); *B01F 25/43163* (2022.01); *B01F 25/431971* (2022.01); *B01F 2025/916* (2022.01); *B01F 2025/919* (2022.01); *B01F 2025/931* (2022.01); *B01F 2101/2204* (2022.01); *B01F 2101/305* (2022.01)

(56) References Cited

U.S. PATENT DOCUMENTS

| | | | | |
|---|---|---|---|---|
| 4,758,098 | A * | 7/1988 | Meyer | B01F 25/43161 366/337 |
| 5,813,762 | A | 9/1998 | Fleischli et al. | |
| 5,944,419 | A | 8/1999 | Streiff | |
| 6,830,370 | B1 | 12/2004 | Uematsu | |
| 7,316,503 | B2 | 1/2008 | Mathys et al. | |
| 9,975,094 | B2 | 5/2018 | Gillis et al. | |
| 2013/0286769 | A1 * | 10/2013 | Baron | B01F 25/4316 366/337 |

FOREIGN PATENT DOCUMENTS

| | | | |
|---|---|---|---|
| CN | 105879732 | A | 8/2016 |
| EP | 0800857 | A1 | 10/1997 |
| JP | 5447791 | U | 4/1979 |
| JP | S555750 | A | 1/1980 |
| JP | S5719020 | A | 2/1982 |
| JP | 6046117 | U | 4/1985 |
| JP | 2006142151 | A | 6/2006 |
| JP | 2009-018232 | A | 1/2009 |
| JP | 2013538684 | A | 10/2013 |
| SG | 182991 | A1 | 8/2012 |
| WO | WO2012/095623 | A1 | 7/2012 |

OTHER PUBLICATIONS

Chinese Search Report dated Nov. 15, 2021 in corresponding Chinese Application No. 201880085288.3.

International Search Report dated Feb. 13, 2019 in corresponding International Patent Application No. PCT/EP2018/080271, filed Nov. 6, 2018.

International Preliminary Report on Patentability and Written Opinion dated May 12, 2020 in corresponding International Patent Application No. PCT/EP2018/080271, filed Nov. 6, 2018.

Japanese Office Action dated May 30, 2022 in corresponding Japanese Application No. 2020-524590.

* cited by examiner

MIXER DUCT AND PROCESS OF OPERATION

CROSS-REFERENCE TO RELATED APPLICATION

This application is a U.S. National Stage application of International Application No. PCT/EP2018/080271, filed Nov. 6, 2018, which claims priority to European Patent Application No. 17200102.6, filed Nov. 6, 2017, the contents of each of which are hereby incorporated herein by reference.

BACKGROUND

Field of the Invention

The present invention relates to an improved mixer duct. The present invention also relates to a process for using said mixer duct.

Background Information

Static mixers are of interest for all industries concerned with mixing and dispersing, gas liquid contacting, or turbulent mixing applications. Static mixers are generally tubular internals that produce desired mixing and dispersion effects as the fluid flows around motionless mixer parts. The fluid flow is typically provided by pumping. Static mixers have advantages over other mixing systems in that they require only small volumes, low maintenance, and they have a simple installation and cleaning, as well as excellent reliability.

A typical static mixer is disclosed in U.S. Pat. No. 6,830,370B1. This document discloses a static mixer consisting of a pair of semi-elliptical vanes disposed criss-crossed to one another at an incline within a duct. Each pair of vanes thus generates a large vortex or swirling motion within the duct. Other representative types of static mixers are known from Sulzer Chemtech, such as those disclosed in EP0800857A1. Such static mixers comprise inclined parallel plates providing open narrow passages including a gap region running from wall to wall through the duct axis. Another similar static mixer is disclosed in U.S. Pat. No. 4,758,098 having at least three transversely spaced webs. The webs are spaced transversely from each other to provide gaps through which a fluid may pass during mixing. In addition, each web while being secured to the casing at the upper ends relative to a downward flow has lower terminal ends which are spaced from the casing to provide further gaps through which the liquid may pass during a downward descent.

The above-described mixers may often be effective and sufficient provided that enough mixing length is available within the duct as well as sufficient pressure head. However, in certain applications there may be insufficient available length or pressure head for their optimum performance. Therefore, it would be desirable to have improved static mixers available to provide sufficient mixing performance under such stringent conditions. For example, when dosing an additive within the mixing duct, it can be quite important to rapidly homogenize the additive concentration within the fluid. This can be quite critical when adding additives that are quite reactive which may then lead to safety or quality issues if the additive is not rapidly and homogeneously distributed within the fluid. In other cases, it may be important to have a homogenous distribution of a reactive additive with the proper reaction stoichiometry before the fluid enters a subsequent reactor.

SUMMARY OF THE INVENTION

Starting from this state of the art, it is a first object of embodiments of the invention to provide an improved mixer duct for mixing of a turbulent flow to provide sufficient mixing performance under stringent conditions such as short available mixing length or limited available pressure head.

A second object of embodiments of the invention includes providing an improved mixer duct for both mixing of a turbulent flow as well as for dosing an additive and rapidly homogenizing the additive concentration within the fluid, for example, when adding additives that are quite reactive or to provide a homogenous distribution of a reactive additive with the proper reaction stoichiometry before the fluid enters a subsequent reactor. Yet further additional objects of embodiments of the invention are to provide a process for mixing a main fluid, optionally with an added additive, taking advantage of the favorable properties of the above-mentioned favorable mixing properties of the improved mixer duct for mixing of a turbulent flow.

According to one embodiment of the invention, the first object is achieved by a mixer duct for turbulent flow having an inlet and an outlet, containing at least one static mixer element which comprises two at least substantially coplanar plate-like segments, wherein a substantially longitudinal gap is formed between the segments, wherein each segment is attached to the duct wall and comprises at least two free edges, wherein one edge is the leading edge and the other edge is adjacent to the longitudinal gap wherein the two segments are inclined relative to the duct axis so that the leading edge is oriented up-stream in the duct and substantially perpendicular to the direction of fluid flow.

Providing two segments inclined relative to the duct axis so that the leading edge is oriented up-stream in the duct has the technical effect that each segment produces a vortex. Each segment is fixed along the duct wall from the upstream portion to the downstream portion of the segment with the leading edge being a free edge located substantially perpendicular to the direction of fluid flow. The effect of the substantially perpendicular leading free edge of the segment is that the fluid is subsequently deflected by the segment leading to an increased under-pressure along the downstream side of the segment and an increased over-pressure along the upstream side of the segment and contributing to the development of large-scale vortexes in the fluid. Conventional static mixers lack this technical effect and thus produce lesser under-pressures and less intense vortexes. One skilled in the art will understand that the process of using this mixer duct for mixing a main fluid in order to homogenize a characteristic of the main fluid will share these same just discussed advantages.

In one embodiment of the mixer duct of the present invention at least one segment, preferably the at least two segments, additionally comprises at least a third free edge. The provision of a third free edge advantageously allows the mixer to be shorter in length thus saving material and installation length and weight. This third free edge will typically be provided at the downstream end of the segment. The vortexes responsible for the mixing are primarily generated in the upstream portion of the segment, and thus the downstream portion of the segment may be shortened, providing a third free edge, without significantly negatively impacting the mixing performance. The number of free edges is not specifically limited in embodiments of the present invention and will depend largely on the simplicity or complexity of the shape of the segments of the static mixer element.

In another embodiment, none of the at least two segments additionally comprises a third free edge. Joining the downstream portion of the segment to the duct wall prevents homogeneities in the flow distribution through the duct as the open area adjacent through a third free edge would allow the free flow of fluid through the duct there.

Preferably, each of the at least one static mixer element comprises exactly two substantially coplanar plate-like segments and no further segment in addition thereto.

In another embodiment, the second object is achieved by providing the duct with at least one additional side inlet located substantially upstream of the static mixer element, preferably the leading edge, embodied for the addition of an additive. Feeding the additive in this way upstream of the static mixer element allows the mixing and homogenization process to take advantage of the large-scale vortexes generated by the segments. Furthermore, by feeding the additives substantially upstream allows a pre-distribution of the additive across the duct cross section which allows for effective homogenization by the subsequent segments. One skilled in the art will understand that the process of using this mixer duct for mixing a main fluid and an additive in order to homogenize the composition of the main fluid and the additive will share these same just discussed advantages.

In another embodiment of the mixer duct fulfilling the second object, the duct additionally comprises a deflection shield, having a width (W), wherein the deflection shield is located substantially parallel to the side inlet axis and substantially perpendicular to the duct axis, wherein the width (W) is at least as great in magnitude as the side inlet diameter, and the deflection shield is substantially located upstream from the side inlet, and the deflection shield is embodied so as not to substantially block the duct entrance of the side inlet and to simultaneously allow the additive to propagate into the central region of the mixer duct without being diverted by the main fluid flow through the mixer duct. The deflection shield acts to block the main fluid flow through the duct in the region near the side inlet so as to advantageously allow the additive entering via the side inlet to propagate further into the interior of the duct before it encounters the main flow. Without the provision of the deflection shield, the additive would simply creep along the duct wall adjacent to the side inlet, particularly additives with low momentum.

In another embodiment of the mixer duct, a splash plate is located substantially in the central region of the mixer duct, wherein the splash plate is oriented substantially parallel to the duct axis so as to not substantially increase the resistance of the main fluid flow through the mixer duct, and wherein the splash plate is simultaneously located substantially perpendicular to the side inlet axis and the splash plate cross-section substantially overlaps the side inlet cross-section when viewed along the side inlet axis. The provision of a splash plate advantageously limits the propagation of the additive across the cross section of the duct. This is important in the case of additives having a high momentum as the risk would be that the bulk of the additive reaches the duct wall opposite the side inlet, which would hinder efficient mixing with the main fluid flow through the cross section of the tube.

According to another embodiment, the second object is achieved by equipping the mixer duct instead with an additive injection tube having at least one injection tube outlet, wherein the additive injection tube is embodied for injecting an additive into the mixer duct substantially upstream of the static mixer element in a region substantially adjacent to at least one leading edge, preferably equidistant from both leading edges of the at least two segments, and wherein the at least one injection tube outlet is embodied so as to direct the additive to one or both leading edges, preferably wherein two injection tube outlets are each located equidistant from a leading edge. This embodiment having an additive injection tube is particularly advantageous for adding additives to mixing ducts in the form of an open channel. In the case of open channels, side inlets are not easy to realize because the side inlet may need to be located under the surface adjacent to the channel, e.g. underground. Furthermore, the liquid depth in an open channel may vary during operation, thus partially or even completely exposing any side inlets. Thus, an additive injection tube may be readily constructed with its outlet located near the bottom of the open channel. In cases of open channels, the leading edges of the segments will also advantageously be located near the bottom of the open channel. One skilled in the art will understand that the process of using this mixer duct for mixing a main fluid and an additive in order to homogenize the composition of the main fluid and the additive will share these same just discussed advantages.

In another embodiment of the previous alternative embodiment, the mixer duct is in the form of an open channel, preferably having a separating wall, wherein the additive injection tube preferably has at least a second injection tube outlet and the open channel preferably has at least a second static mixer element located adjacent to said static mixer element. This embodiment is particularly advantageous when the open channel is relatively wide relative to its depth, for example, twice as wide as deep or more. The vortexes generated are most efficient in embodiments of the present invention when the cross-section of the duct is approximately square. Thus, wider open channels may be effectively divided into smaller approximately-square cross-sections by means of one or more dividing walls. Each of these thus-created divided sections of the duct may be then conveniently fed by additional additive injection tube outlets located in front of or within each of these sections. Alternatively, each or several sections could be fed by means of a single additive injection tube and its outlet(s).

Another embodiment of the mixer duct of the present invention contains additional static mixer elements, preferably one to three additional static mixer elements, more preferably one or two additional static mixer elements and most preferably one additional static mixer element, wherein the static mixer elements are arranged—viewed in the longitudinal direction of the mixer duct—spatially apart from each other one after another. Two or more static mixer elements being arranged spatially apart from each other one after another lead to a particular excellent mixing capacity. It is preferred in this embodiment that the static mixers are progressively rotated by between about 70 to about 110, preferably about 80 to about 100, more preferably about 90, degrees relative to each other around the duct axis proceeding in a downstream direction. This embodiment has the advantage that the orientation of the structure of the vortexes generated within the mixer duct does not remain constant along the length of the mixer duct, and instead, it is then systemically rotated along the length of the mixer duct which promotes a faster and more homogeneous mixing within the mixer duct.

In an alternative embodiment of the mixer duct of the present invention, the mixer duct is in the form of an open channel containing additional static mixer elements, preferably one to three additional static mixer elements, more preferably one or two additional static mixer elements, wherein the static mixers are not substantially rotated relative to one another so that their cross-sections substantially overlap when viewed along the open channel axis. In open channels, the depth of the liquid may not be constant and in particular may not fill the channel completely. Therefore, certain orientations of static mixer elements may be ineffective. In an open channel mixer duct, the level of the liquid is not defined and may vary, and therefore it is not possible to properly position the at least substantially coplanar plate-like segment along the top of the open channel as it may be exposed to varying levels of liquids. For this reason, it is preferred in open channel mixer ducts that the at least substantially coplanar plate-like segments are located along the vertical side walls.

One skilled in the art will understand that the combination of the subject matters of the various claims and embodiments of the invention is possible without limitation in the invention to the extent that such combinations are technically feasible. In this combination, the subject matter of any one claim may be combined with the subject matter of one or more of the other claims. In this combination of subject matters, the subject matter of any one mixer duct claim may be combined with the subject matter of one or more other mixer duct claims or the subject matter of one or more process claims or the subject matter of a mixture of one or more mixer duct claims and process claims. By analogy, the subject matter of any one process claim may be combined with the subject matter of one or more other process claims or the subject matter of one or more mixer duct claims.

BRIEF DESCRIPTION OF THE DRAWINGS

The embodiments of the invention will be explained in more detail hereinafter with reference to the drawings.

DETAILED DESCRIPTION OF THE EMBODIMENTS

Figure 1A:
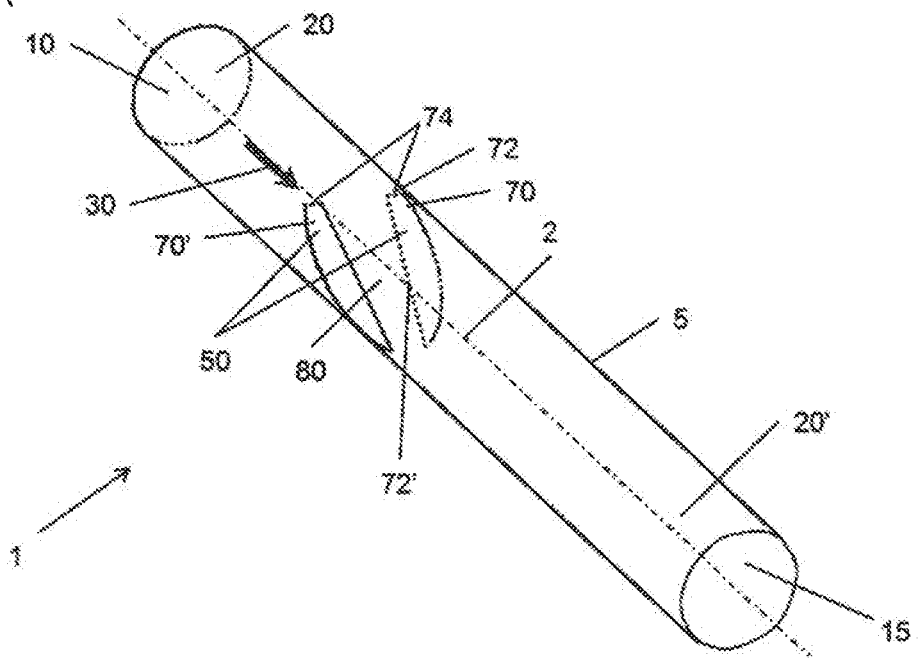
FIG. 1A shows a schematic view of one embodiment of a mixer duct according to the present invention having one static mixer.

As used in the specification and claims of this application, the following definitions, should be applied:

"a", "an", and "the" as an antecedent may refer to either the singular or plural unless the context indicates otherwise.

"Duct" as in "mixer duct" in the present application refers to any suitable duct for conveying a fluid which may contain one or more static mixer elements. Typical ducts may be closed ducts, such as a pipe having a substantially circular cross-section or a duct having other geometric cross-sections such as square or rectangular. Other suitable ducts for the present disclosure may be in the form of open channels such as those having a bottom and two substantially vertical side walls. The "diameter" in the present application refers to the hydraulic diameter (see for example, https://en.wikipedia.org/wiki/Hydraulic_diameter) for a non-circular duct.

"Static mixer element" in the present application refers to a static mixer type based on at least two at least substantially coplanar plate-like segments, such as those disclosed in U.S. Pat. Nos. 4,758,098 and 4,019,719. These segments may be unattached to each other or partially attached, as in a substantially U-shaped static mixer element.

"At least substantially coplanar plate-like segments" means in accordance with the present disclosure that the plate-like segments are inclined with each other with regard to the longitudinal plane of the outer duct wall by not more than 10°, preferably by not more than 5°, more preferably by not more than 2.5° and most preferably by not more than 1°.

"Segments" in the present application refers to a substantially flat plate having at least two free edges. In one embodiment it is a flat plate.

"Free edge" in the present application refers to an edge of the segment which is not attached to something, for example, is not attached to the mixer duct, in particular the mixer duct wall.

"Leading edge" in the present application refers to a free edge, which is oriented substantially upstream, thus towards the source of the fluid flow. It is noted that the leading edge is not required to be to be one single straight edge, but it may be curved or rounded or comprise multiple partial edges, like the edge of a polyhedron. It is important that the majority of the leading edge is substantially perpendicular to the direction of fluid flow.

"Leading edge substantially perpendicular to the direction of a main fluid flow" means in accordance with the present disclosure that the leading edges are inclined with regard to the plane being perpendicular to the direction of the longitudinal axis of the outer duct wall by not more than 20°, preferably by not more than 10°, more preferably by not more than 5° and most preferably by not more than 2°.

Generally, "substantially perpendicular" means that the concerned part is inclined with regard to the respective plane, to which it is substantially perpendicular, by 70 to 110°, preferably by 80 to 100°, more preferably by 85 to 95° and most preferably by more than 88 to 92°.

"Substantially parallel" means that one the concerned parts extends with a deviation of at most 20%, preferably of at most 10%, more preferably of at most 5% and most preferably of at most 2% parallel to the other part.

"Central region of the duct" in the present application refers to the region of the duct located closer to the center of gravity of the duct than to a duct wall. In one embodiment it is the central core of the duct located within a distance of ½ of the radius for a circular duct or ¼ of the hydraulic diameter for a non-circular duct.

"Longitudinal gap" in the present application refers to the open space between the at least two at least substantially coplanar plate-like segments. This open space or gap may or may not have a uniform width between the segments, and it may run the entire length of the segment for segments that are not attached to one another. Or it may be a partial length for two at least substantially coplanar plate-like segments that are partially attached to one another, for example, in the case of a substantially U-shaped static mixer element. "Substantially longitudinal gap" means in this connection that the length of the gap is longer than the width of the gap. If the length of the gap is not equal over the width of the gap and/or the width of the gap is not equal over the length of the gap, then the average length of the gap is longer than the average width of the gap.

"Side inlet" in the present application refers to an inlet through the wall of the duct, for example, for feeding of a fluid such as an additive. The cross-section of the side inlet is not specifically limited but it will be often substantially circular as in the case of a pipe for feeding a fluid via the side inlet.

"Additive injection tube" in the present application refers to a tube of circular or other cross-section for adding a fluid such as an additive into an interior portion of the mixer duct. In some embodiments it will be in the form of a sparger. In some embodiments it may have more than one outlet into the mixer duct in order to improve the pre-distribution of the additive as it enters the mixer duct.

Numerical values in the present application relate to average values. Furthermore, unless indicated to the contrary, the numerical values should be understood to include numerical values which are the same when reduced to the same number of significant figures and numerical values that differ from the stated value by less than the experimental error of the conventional measurement technique of the type described in the present application to determine the value.

FIG. 1A shows a schematic view of one embodiment of a mixer duct, which as a whole is labeled with reference number 1. The mixer duct 1 is not specifically limited as to form, shape, construction or composition unless specifically indicated otherwise. Any suitable material that can be fabricated can be made into mixer duct 1. For reasons of economy, such systems 1 are often made from stainless steel or another material indicated for the specific application.

In this figure, it is shown that a main fluid 20 enters the mixer duct 1 by means of mixer duct inlet 10 and flows through the mixer duct in the direction of the main fluid flow 30, which is generally parallel to the mixer duct axis 2. The main fluid flow 30 next encounters a static mixer element 50 which comprises at least two coplanar plate-like segments 70. The segments 70 have a substantially longitudinal gap 80 between them, and each segment 70 is attached to the mixer duct wall 5 and comprises at least two free edges 72, 72'. One free edge 72 is the leading edge 74 and the other free edge 72' is adjacent to the longitudinal gap 80. It is shown that the two segments 70, 70' are inclined relative to the duct axis 2 so that the leading edge 74 is oriented up-stream in the duct 1 and substantially perpendicular to the direction of a main fluid flow 30. It is noted that the segments 70 and 70' of the static mixer element 50 in this embodiment both lack a third free edge 72". After encountering the static mixer element 50, the homogenized main fluid 20' propagates further through the mixer duct 1 and exits by means of mixer duct outlet 15.

The segments 70 and 70' in the present disclosure may be partially joined somewhat similarly as in the static mixer shown in FIG. 1A of EP0800857 (A1). In embodiments of the present invention, however, the partial joining of the segments 70 and 70' will be on the downstream portion of the static mixer element 50 and thus not adjacent to the leading edge 74.

The angle of inclination is typically preferably between about 20 and about 50 degrees, and generally the segments 70 and 70' are substantially parallel to one another and thus have substantially the same angle of inclination relative to the duct axis 2. The length of the segments 70 and 70' is typically between about ½ and twice the average width or diameter of the mixer duct 1. The shape of the segments 70 and 70' is not specifically limited, and it may be semi-circular for substantially round mixer ducts 1, as shown in FIG. 1A. Typically, the width of longitudinal gap 80 may be between about 40 and about 70% of the average diameter or width of the mixer duct 1. The shape of the inner free edges 72 of the segments 70 and 70' defining the substantially longitudinal gap 80 between them is not specifically limited and may be substantially straight, curved, beveled, bent, and may comprise one or more discontinuities, curves, bends or angles.

Figure 1B:
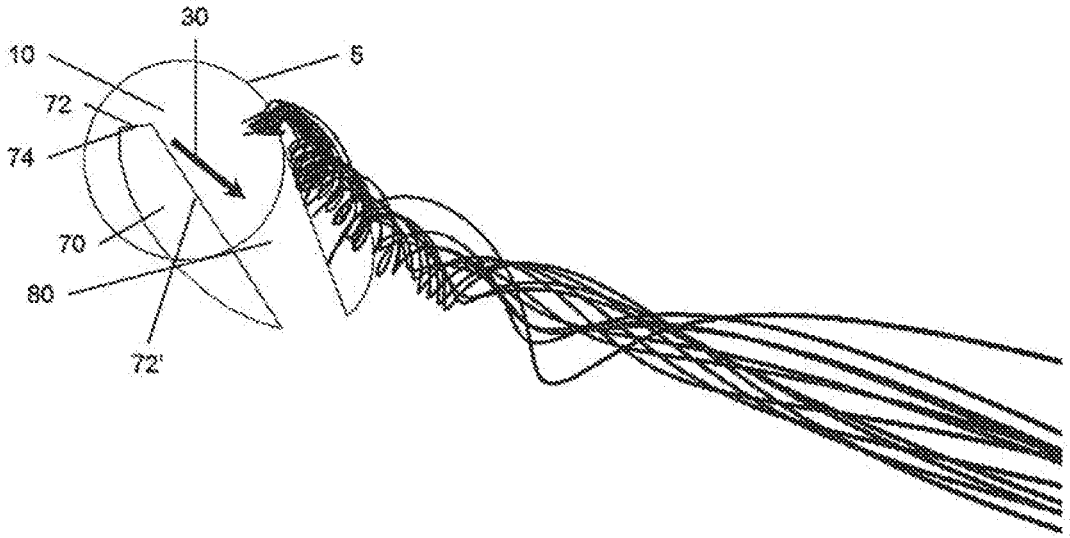
FIG. 1B shows a schematic view of one of the vortexes generated by the mixer duct shown in FIG. 1A.

FIG. 1B shows a schematic view of one of the vortexes generated by one of the segments 70 in the mixer duct 1 shown in FIG. 1A. In this figure, stream lines originating in a region directly upstream of the leading edge 74 are shown. It is shown that the vortex is formed along the back or downstream side of the segment 70 and its free edge 72' adjacent to the longitudinal gap 80. The vortex subsequently propagates further through the mixer duct 1 together with the main fluid 20 in the direction of main fluid flow 30.

Figure 2:
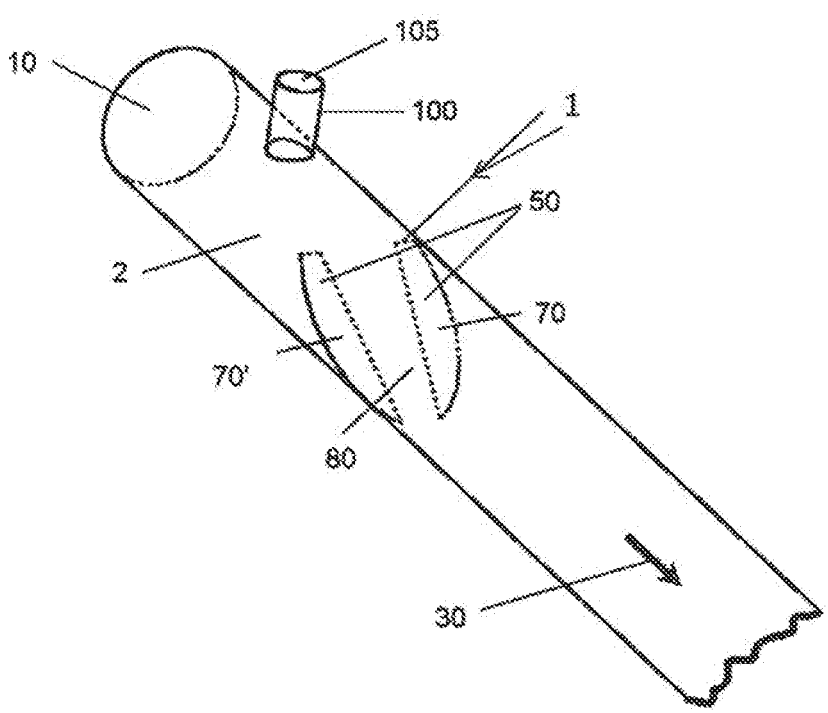
FIG. 2 shows a schematic view of one embodiment of a mixer duct having a side inlet.

FIG. 2 shows an embodiment of a mixer duct 1 having a static mixer element 50 made of two segments 70, 70' with an intervening gap 80 and both lacking a third free edge 72" as in FIG. 1A. This embodiment additionally comprises an additional side inlet 100 located substantially upstream of the static mixer element 50 embodied for the addition of an additive 120. As shown and preferred the side inlet 100 is located substantially upstream of the leading edge 74, typically between about 50% and about 200% of the mixer duct 1. More than one side inlet 100 may be used in some embodiments, for example, for the injection or introduction of more than one additive.

Figure 3:
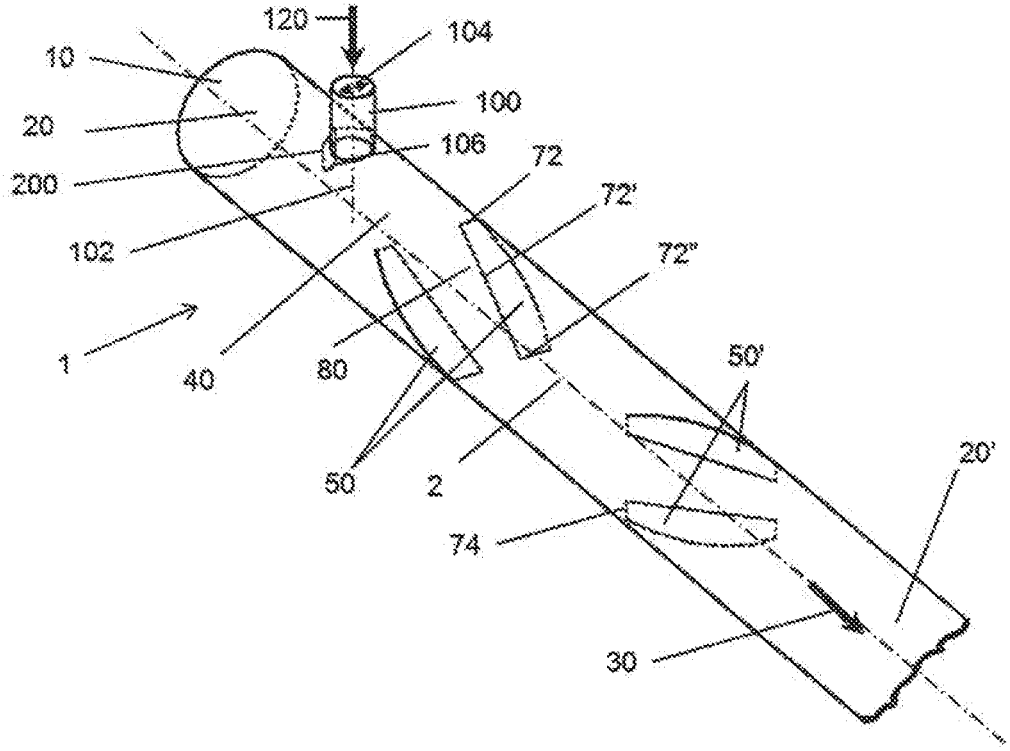
FIG. 3 shows a schematic view of one embodiment of a mixer duct having a side inlet and a deflection shield and two static mixers, each having a third free edge.

FIG. 3 shows a further embodiment of a mixer duct 1 having two static mixer elements 50 and 50' and a side inlet 100 with a diameter 104 and having a deflection shield 200 located substantially parallel to the side inlet axis 102 and substantially perpendicular to the duct axis 2. The deflection shield 200 is substantially located upstream from the side inlet 100. The deflection shield 200 is embodied so as not to substantially block the duct entrance 106 of the side inlet 100. Thus, the deflection shield 200 simultaneously allows the additive 120 to propagate into the central region 40 of the mixer duct 1 without being diverted by the main fluid flow through the mixer duct 1. The design of the deflection shield 200 is not specifically limited, and it may be round, V-shaped as in FIG. 3, U-shaped, and the cross-section may generally be, for example, rectangular, semicircular. The length of the deflection shield 200 in a direction perpendicular to the duct axis 2 and parallel to the side inlet axis will generally be between about 20% and about 60% of the diameter of the duct 1.

It is noted that the segments 70 of the static mixer elements 50 and 50' in this embodiment both have a third free edge 72". Similar to the shape of the segments 70 and 70' discussed in relation to FIGS. 1A and 1B, the free edges 72' defining the substantially longitudinal gap 80 are also not specifically limited, and the free edges may be substantially parallel or non-parallel to one another. In one embodiment, the angle between them may be up to +15°. The construction and fastening of the deflection shield 200 is not specifically limited, and it may be simply welded or glued into the duct 1 depending on the materials of construction, or it may optionally be mounted by means of brackets, for example, for larger-scale installations.

Figure 4A:
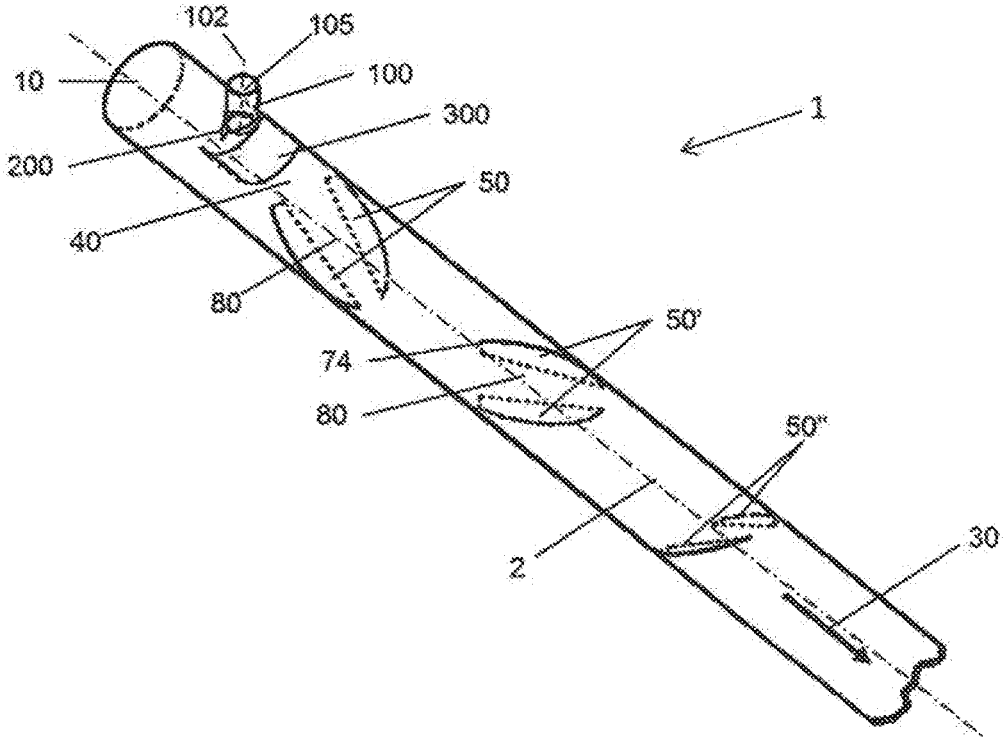
FIG. 4A shows a schematic view of one embodiment of a mixer duct having a side inlet, a deflection shield, a splash plate and three static mixers, each without a third free edge.

FIG. 4A shows a schematic view of one embodiment of a mixer duct 1 having a side inlet 100, a deflection shield 200, a splash plate 300 and three static mixers 50, 50' and 50", each without a third free edge 72". The splash plate 300 is located substantially in the central region 40 of the mixer duct 1, and the splash plate 300 is oriented substantially parallel to the duct axis 2 so as to not substantially increase the resistance of the main fluid flow through the mixer duct 1. The splash plate 300 is simultaneously located substantially perpendicular to the side inlet axis 102 so as to advantageously limit the propagation of the additive across the cross section of the duct 1, as described earlier.

Figure 4B:
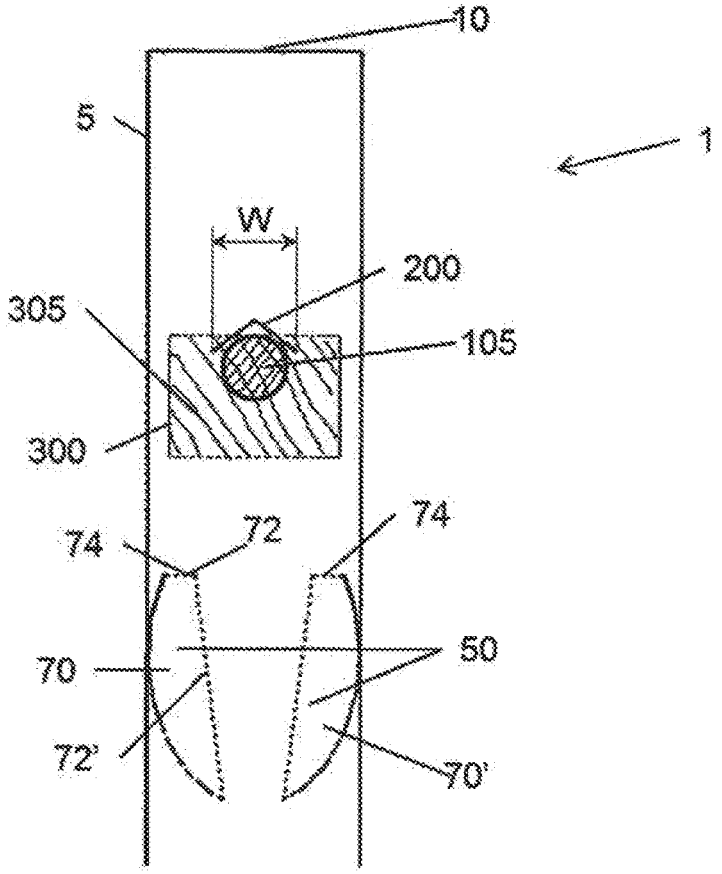
FIG. 4B shows a schematic partial top view of this embodiment illustrating a splash plate having a cross-section substantially overlapping the side inlet cross-section.

FIG. 4B shows a schematic partial top view of the embodiment of FIG. 4A illustrating a splash plate 300 having a cross-section 305 substantially overlapping the side inlet cross-section 105 when viewed along the side inlet axis 102. As shown here, the width W of the deflection shield 200 is at least as great in magnitude as the side inlet diameter 104. [0059] The construction and fastening of the splash plate 300 is not specifically limited, and it may be simply welded or glued into the duct 1 depending on the materials of construction, or it may optionally be mounted by means of brackets, for example, for larger-scale installations. The design of the splash plate 300 is not specifically limited, and it may be round, V-shaped, U-shaped as in FIG. 4A, and the cross-section may generally be, for example, rectangular, semicircular. The length of the splash plate 300 in the direction of the duct axis 2 will generally be greater than the side inlet diameter 104 and may extend up to one or two diameters of the duct 1.

Figure 5A:
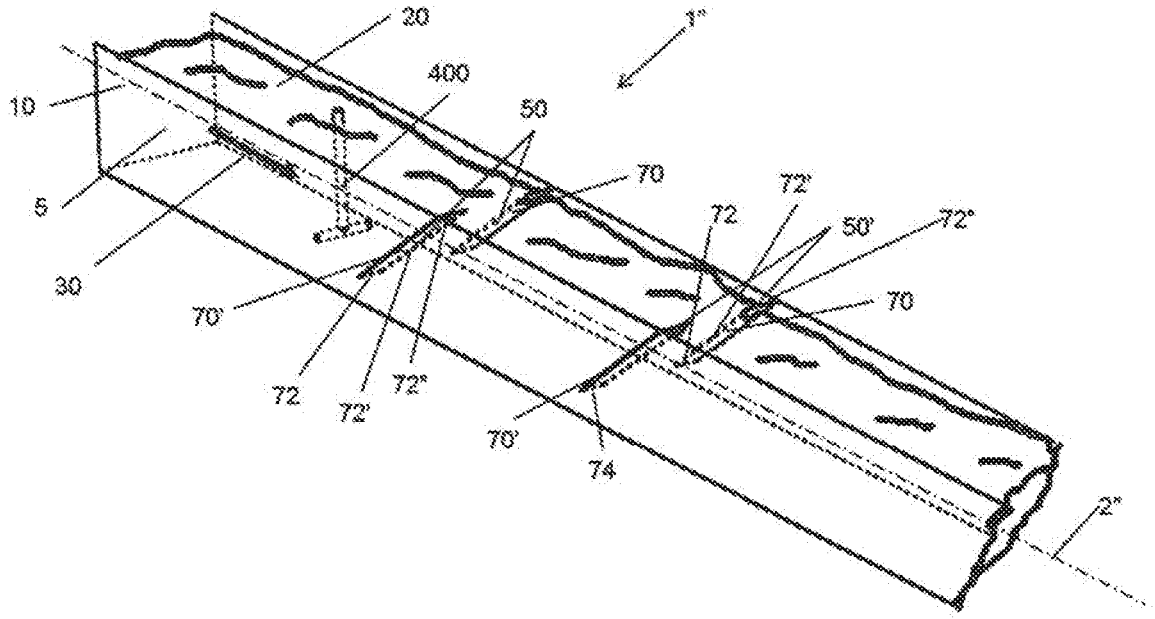
FIG. 5A shows a schematic view of one embodiment of a mixer duct in the form of an open channel and having an additive injection tube and two static mixers.

FIG. 5A shows a schematic view of one embodiment of a mixer duct 1 in the form of an open channel 1" having a mixer duct wall 5, a mixer duct inlet 10, and having an additive injection tube 400 and two static mixers 50 and 50'. As shown here, the static mixers 50 and 50' are not substantially rotated relative to one another so that instead their cross-sections substantially overlap when viewed along the open channel axis 2". The additive injection tube 400 will generally be located substantially upstream of the next closest static mixers 50 or 50', typically at a distance of between about 5% to about 200% relative to either the duct 1" width or depth. More than one additive injection tube 400 may be used in various embodiments, for example, for the introduction of more than one additive or for introducing an additive at different heights or depths below the surface of the main fluid 20 within the open channel duct 1". Furthermore, the segments 70 and 70' have three free edges 72, 72', and 72" in this open channel embodiment. As seen here, the segments 70 and 70' may emerge from the main fluid 20 depending on the level of the main fluid 20 in the open channel 1".

Figure 5B:
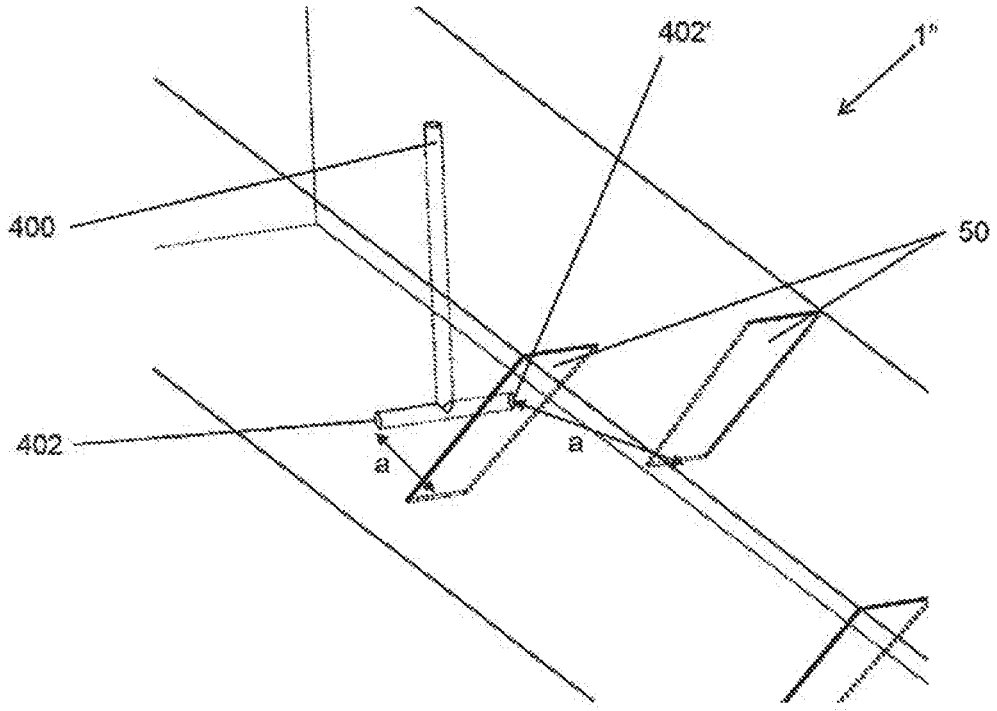
FIG. 5B shows an expanded view of the region near the additive injection tube.
Figure 5C:
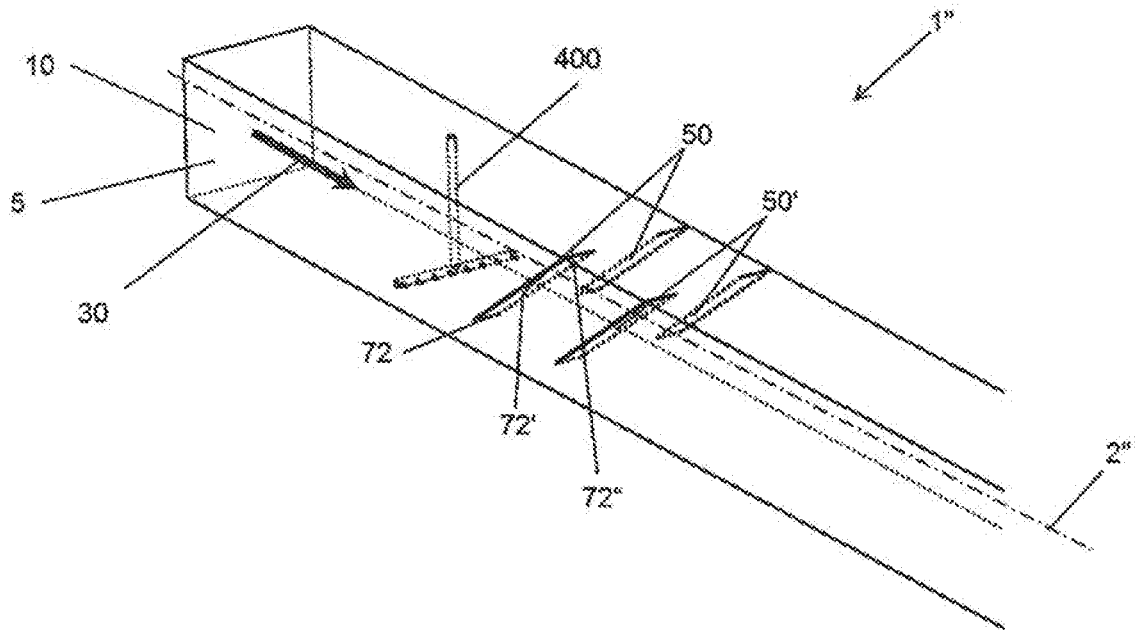
FIG. 5C shows an alternative embodiment with an additive injection tube having multiple outlets.
Figure 5D:
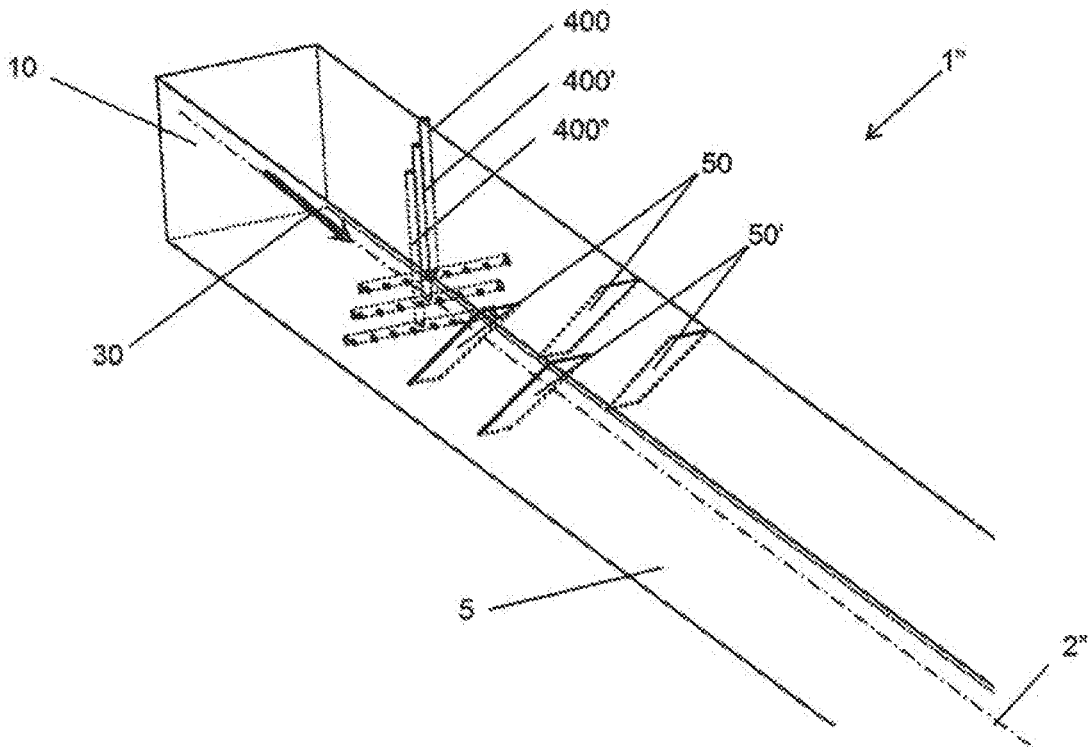
FIG. 5D shows another alternative embodiment with an additive injection tube having multiple outlets.

FIG. 5B shows an expanded view of the region near the additive injection tube 400, in which it may be seen that the two injection tube outlets, 402 and 402', are each located substantially equidistant from a leading edge 74. FIGS. 5C and 5D show alternative embodiments of additive injection tubes 400 having multiple outlets 402 and 402', in the case of FIG. 5C the multiple outlets 402 and 402' are distributed substantially horizontally, and in FIG. 5D they are distributed substantially vertically, in this case over multiple additive injection tubes 400, 400', and 400". Preferably, in both cases such as in FIGS. 5C and 5D, they are distributed substantially homogeneously with a substantially regular spacing. In other embodiments the multiple outlets 402 and 402' may be distributed both horizontally as well as vertically over the same or multiple additive injection tube(s) 400, as is seen in FIG. 5D, as well as being distributed over the cross-section, optionally central region 40, of the open channel mixer duct 1". One skilled in the art will understand that analogous additive injection tubes 400 having multiple outlets 402 and 402' may also be employed in the case of other mixer ducts 1 in accordance with embodiments of the present invention.

Figure 6:
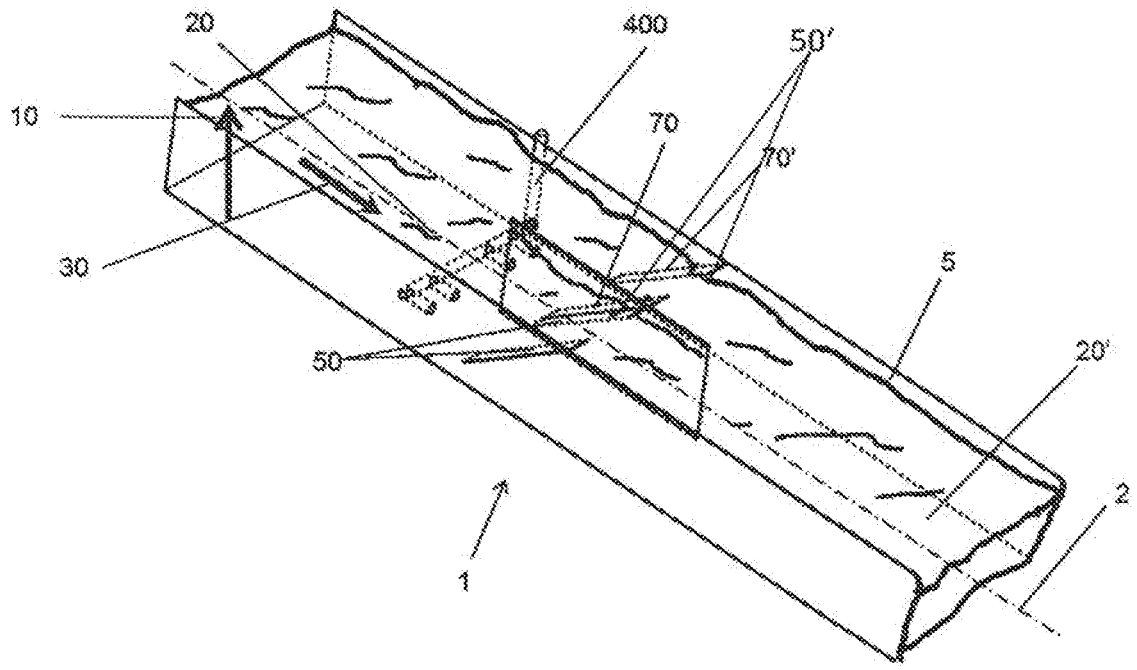
FIG. 6 shows a schematic view of one embodiment of a mixer duct in the form of an open channel and having a separating wall, an additive injection tube with multiple outlets and two static mixers located adjacent to one another.

FIG. 6 shows a schematic view of one embodiment of an open channel mixer duct 1" having a separating wall 420, an additive injection tube 400 with multiple injection tube outlets 402 and 402' and two static mixers 50 and 50' located adjacent to one another. It may be seen that the multiple injection tube outlets 402 and 402' and the two static mixers 50 and 50' are distributed substantially homogeneously over the two open sub-channels created by the separating wall 420. The separating wall 420 will generally separate or divide the entire flow of the main fluid 20 through the open duct 1", and thus it will generally extend from substantially the bottom floor to the top level of the main fluid 20 during operation. In some embodiments the height of the separating wall 420 will be substantially the same as the height of the mixer duct wall(s) 5. The separating wall 420 will generally extend past any static mixers 50 and 50' present in the open duct 1", optionally past the first horizontally adjacent static mixers 50 and 50', for example, by a distance equivalent to 1×, 2×, or 3× the maximum length of the static mixers 50 and 50'. Such open channel mixer duct 1" embodiments featuring a separating wall 420 will typically be employed when the open duct 1" has a width that is substantially greater in length than the length of the height of the open duct 1". One skilled in the art will understand that for the case of relatively wide open ducts 1" multiple separating walls 420 and 420' and multiple horizontally adjacent static mixers 50, 50' and 50" may be used.

One skilled in the art will understand that besides multiple adjacent static mixers 50, 50' and optionally 50" etc. being distributed horizontally along the duct axis 2", as for example in FIGS. 5A to 5C, or being distributed horizontally over the width of the open channel duct 1", as in FIG. 6, instead multiple adjacent static mixers 50, 50' and optionally 50" etc. may be distributed substantially vertically (over the height) within the open duct 1". In this manner, greater vortex generation and thus better mixing may be achieved within a shorter mixer duct 1" length along the duct axis 2", which beneficially would facilitate a more compact mixer duct 1". One skilled in the art will understand that similar embodiments and configurations of multiple static mixers 50, 50' and optionally 50" etc. may be employed for other mixer ducts 1 in accordance with embodiments of the present invention.

Suitable main fluids 20 in embodiments of the present invention are not specifically limited, and they may be in either liquid or gas form. Thus, in many embodiments, the mixer duct inlet 10 will be in fluid communication with a source of a liquid or gas flow. Typical applications of the mixer duct 1 include mixing of reactants in front of a chemical reactor, temperature homogenization of fluids after a source of heating or cooling, for the homogenization of fluids with additives, for example, in chemical plants. Thus, in some embodiments, the mixer duct inlet 10 will be in fluid communication with one or more sources of liquid and/or gas reactants, a source of liquid and/or gas heating or cooling, or a source(s) of a fluid and one or more additives. In some embodiments, the mixer duct 1 and these fluid sources will be part of a chemical plant comprising them. Other embodiments of the mixer duct 1 may find use in petrochemical refineries and plants for the admixture of various grades of crude oil or other petrochemicals in order to make a defined grade product. Thus, in some embodiments, the mixer duct inlet 10 will be in fluid communication with a source of crude oil and/or crude oil grades and/or other petrochemicals. In some embodiments, the mixer duct 1 and these various oil and petrochemical sources will be part of a petrochemical plant or refinery comprising them. Embodiments of both mixer duct 1 and open channel mixer duct 1" may find application in water treatment, for example, for pH control and/or admixing of flocculants and/or biocides. Thus, in many embodiments the mixer duct inlet 10 of the mixer duct 1 or open channel mixer duct 1" will be in fluid communication with a source of water, for example, waste or process water and optionally a source(s) of one or more additives. In some embodiments, the mixer duct 1 or open channel mixer duct 1" and these water sources will be part of a water or waste water treatment plant comprising them.

One skilled in the art will understand that the above discussed ducts 1 and 1", their sources and plants will also apply to process or method embodiments and claims.

Figure 7:
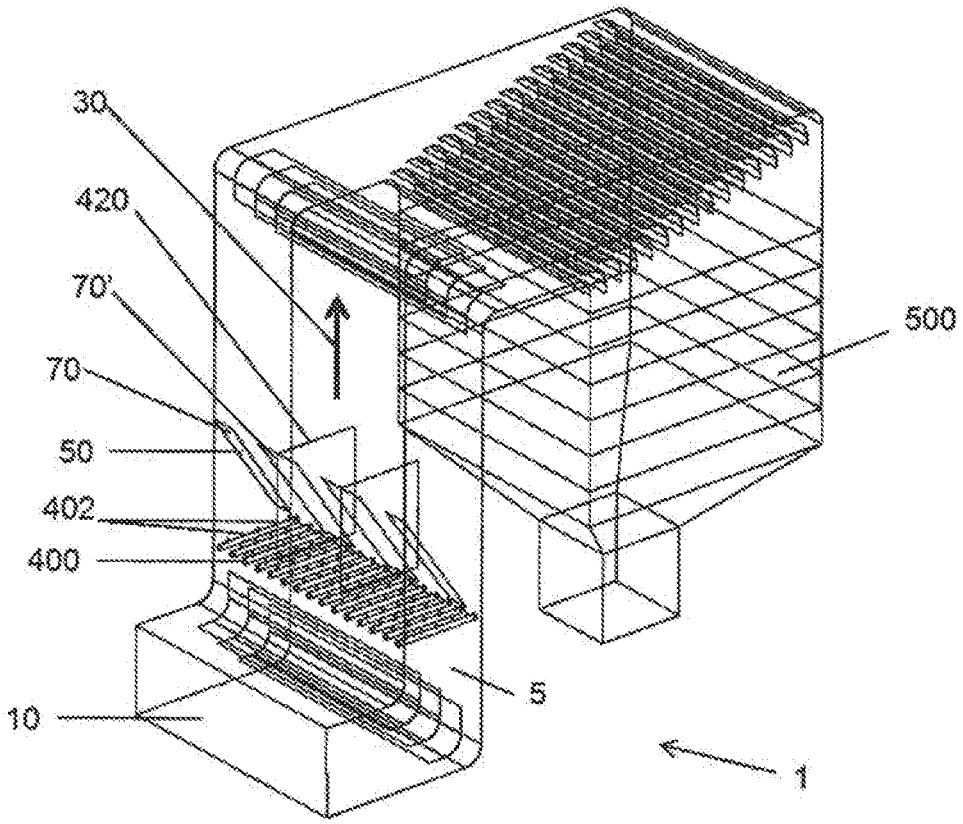
FIG. 7 shows a schematic view of one embodiment of a mixer duct in a flue gas denitrification (DeNox) application

FIG. 7 shows an embodiment of a mixer duct 1 with a rectangular cross-section for a gas as the main fluid 20. In this embodiment the main fluid 20 is a flue gas, for example, from an industrial burner. In a Selective Catalytic Reaction (SCR) reactor 500, which is in fluid communication with the mixer duct outlet 15, a reaction takes place in which nitrogen oxides (NOx) are converted to water and nitrogen. In order to enable this reaction, ammonia (additive 120) needs to be added to the flue gas (main fluid 20) and well-mixed to give a homogenized main fluid 20' having the correct stoichiometric mixture of ammonia and NOX required for this reaction in the subsequent SCR reactor 500. Thus, as shown in this figure, the untreated flue gas enters the mixer duct inlet 10 and flows upward towards the inlet of the SCR reactor 500. It is seen that the mixer duct 1 is divided into parallel closed rectangular sub-channels by means of separating walls 420. Next ammonia is added to the flue gas near the entrance to the sub-channels by means of the additive injection tubes 400 and their outlets 402. One skilled in the art will understand that alternatively the ammonia may be added within the sub-channels. Subsequently the ammonia and the flue gas are well-mixed by the static mixer elements 50 before they enter into the SCR reactor 500. Not only the ammonia and flue gas are well-mixed by this process, but also the concentration profile of the NOx and the temperature profile of the mixture are simultaneously and beneficially homogenized.

As is shown in FIG. 7, the two segments 70 in each sub-channel in this embodiment are unattached to each other, but they are attached to the separating walls 420 and/or the mixer duct wall 5. The longitudinal gap between them is also substantially straight and runs the entire length of the segment. The angle of inclination of the segments 70 are shown to be substantially the same as the segments 70 are substantially parallel to one another within the same plane.

While various embodiments have been set forth for the purpose of illustration, the foregoing descriptions should not be deemed to be a limitation on the scope herein. Accordingly, various modifications, adaptations, and alternatives can occur to one skilled in the art without departing from the spirit and scope herein.

The invention claimed is:

1. A mixer duct for mixing of a turbulent flow, the mixer duct comprising:

an inlet;

an outlet in fluid communication with the inlet; and a static mixer element located between the inlet and the outlet, the static mixer element including two at least substantially coplanar plate-like segments meaning that the plate-like segments are inclined with each other with regard to a longitudinal plane of an outer duct wall by not more than 10°, with the static mixer element comprising exactly two at least substantially coplanar plate-like segments and no further segment in addition thereto, and with the two at least substantially coplanar plate-like segments being spaced apart by a substantially longitudinal gap, each segment attached to a duct wall and comprising at least two free edges, with one free edge being a leading edge and the other free edge adjacent to the longitudinal gap;

the two segments inclined relative to a duct axis so that their leading edge is oriented up-stream in the mixer duct and substantially perpendicular to a direction of a main fluid flow, wherein the static mixer element is linearly spaced from any other static mixer element in the direction of the duct axis, if the mixer duct contains one or more further static mixer element.

2. The mixer duct of claim 1, the two segments further comprising a third free edge.

3. The mixer duct of claim 1, none of the two segments comprising at least a third free edge.

4. The mixer duct of claim 1, further comprising at least one side inlet located upstream of the static mixer element, the at least one side inlet configured for addition of an additive.

5. The mixer duct of claim 4, further comprising a deflection shield having a width, the deflection shield located substantially parallel to a side inlet axis and substantially perpendicular to the duct axis, the width being at least as great in magnitude as a side inlet diameter, the deflection shield located upstream from the side inlet, and the deflection shield embodied so as not to block a duct entrance of the side inlet and to simultaneously allow the additive to propagate into a central region of the mixer duct without being diverted by the main fluid flow through the mixer duct.

6. The mixer duct of claim 4, further comprising a splash plate located in a central region of the mixer duct, the splash plate oriented substantially parallel to the duct axis so as to not increase resistance of the main fluid flow through the mixer duct, and the splash plate simultaneously located substantially perpendicular to a side inlet axis and a splash plate cross-section overlaps a side inlet cross-section when viewed along the side inlet axis.

7. The mixer duct of claim 1, further comprising an additive injection tube having at least one injection tube outlet, wherein the additive injection tube is embodied for injecting an additive into the mixer duct upstream of the static mixer element in a region adjacent to at least one leading edge, wherein the at least one injection tube outlet is embodied so as to direct the additive to one or both leading edges.

8. The mixer duct of claim 1, the mixer duct comprising a plurality of static mixer elements, wherein the plurality of static mixer elements are progressively rotated by between about 70 to about 110 degrees relative to each other around the duct axis proceeding in a downstream direction.

9. The mixer duct of claim 1, the inlet being in fluid communication with a source of a liquid or gas flow, the source of the liquid or gas flow providing at least one of: (i) a flow of liquid or gas heating or cooling; (ii) a flow of a fluid and one or more additives; (iii) a flow of crude oil, crude oil grades, or other petrochemicals; or (iv) a flow of water.

10. The mixer duct of claim 1, the mixer duct forming an open channel, and the open channel contains an additional static mixer element, the static mixer elements not rotated relative to one another so that their cross-sections overlap when viewed along an open channel axis.

11. The mixer duct of claim 1, the mixer duct forming an open channel having a separating wall, the mixer duct further comprising an additive injection tube with at least a second injection tube outlet and the open channel comprising at least a second static mixer element located adjacent to the static mixer element.

12. A chemical plant, petrochemical plant, refinery or water treatment plant comprising the mixer duct and the source of claim 9.

13. The mixer duct of claim 1, wherein the inlet is in fluid communication with a source of a liquid or gas flow.

14. A water treatment plant comprising the mixer duct and the source of claim 13.

15. A process of mixing a main fluid in the mixer duct of claim 1 to homogenize a characteristic of the main fluid, the process comprising:

feeding the main fluid to be homogenized to the inlet, removing a homogenized fluid from the outlet.

16. The process of claim 15, the homogenization of the characteristic of the main fluid comprising mixing the main fluid and an additive in the mixer duct to homogenize the composition of the main fluid and the additive, the process further comprising:

feeding the additive to the mixer duct by means of a side inlet or an additive injection tube, mixing the additive into the main fluid within the mixing duct, removing a homogenised composition comprising the main fluid and additive from the outlet.

* * * * *